US005154542A

United States Patent [19]

Klenert

[11] Patent Number: 5,154,542

[45] Date of Patent: Oct. 13, 1992

[54] EARTH-RETAINING MODULE, SYSTEM AND METHOD

[76] Inventor: Oskar H. Klenert, P.O. Box 249, No. Easton, Mass. 02356

[21] Appl. No.: 829,908

[22] Filed: Feb. 3, 1992

[51] Int. Cl.[5] ..... E02D 29/02

[52] U.S. Cl. ..... 405/286; 405/33; 405/284; 52/169.4; 52/604

[58] Field of Search ..... 405/16, 30, 31, 33, 405/262, 284, 285, 286, 287; 52/169.4, 604; 47/83

[56] References Cited

U.S. PATENT DOCUMENTS

| | | | |
|---|---|---|---|
| 4,619,560 | 10/1986 | Crinnion et al. | 52/604 X |
| 4,964,761 | 10/1990 | Rossi | 405/286 |
| 5,108,231 | 4/1992 | Rausch | 405/284 |

FOREIGN PATENT DOCUMENTS

| | | | |
|---|---|---|---|
| 322667 | 7/1989 | European Pat. Off. | 47/83 |
| 3025870 | 2/1982 | Fed. Rep. of Germany | 52/169.4 |
| 2550812 | 2/1985 | France | 52/169.4 |

*Primary Examiner*—Randolph A. Reese
*Assistant Examiner*—Arlen L. Olsen
*Attorney, Agent, or Firm*—Richard P. Crowley

[57] ABSTRACT

An earth-retaining module for use in an interlocked, earth-retaining wall system, and to a method of preparing an earth-retaining wall system, wherein the module comprises a front wall and side walls, to form a structure to receive earth or sand therein, the side walls having a rear, straight, sloped, side section extending from the top of the side walls to a defined height of the rear of the side walls. The side walls have open notches in the top sections therein and longitudinally aligned, to permit the insertion of the front-wall section of another module in a higher row within the open notches. The side walls have inward, rear projections, to retain a dead-man slab element, with the removable dead-man slab element placed on the rear-mounting side walls. The module includes a plurality of holes in the side walls, to permit the side walls of adjoining modules to be secured together by pins or bolts. The system comprises arranging the secured, side-by-side modules in rows and stepped back from the first row in an interlocked manner, by insertion of the front row of the module in the open notches of the lower modules, and filling the secured, interlocked modules with earth or sand.

19 Claims, 2 Drawing Sheets

EARTH-RETAINING MODULE, SYSTEM AND METHOD

BACKGROUND OF THE INVENTION

It is desirable to provide for the stabilization of earthen embankments, and more particularly to stop the erosion of sand from dunes on ocean beaches, which erosion is particularly caused by severe storm conditions or aggressive weather conditions, or related to the naturally occurring phenomenon of soil erosion and movement.

It is believed that, within the last 40 years, at least 30 or 40 feet of ocean front have been lost, due to sand erosion. One present technique of stabilizing earthen embankments or stopping the erosion of sand is to employ massive, unsightly and environmentally intrusive structures, such as the use of concrete sea walls and driven piles or revetments employing massive stones, all of which structures typically need footings and evacuations, or disturb the environment. These structures typically are aesthetically unpleasing, since they are visible. Earthen embankments also have attempted to be stabilized, by the use of step-back or terraced railroad ties or concrete blocks, and which stabilization of earthen embankments is subject to the same disadvantages as those massive structures typically employed, in an attempt to stop the erosion of sand on beaches.

It is, therefore, desirable to provide for a new module, system and method, to stabilize earthen embankments and to stop sand erosion along beaches, and to avoid the disadvantages of prior-art techniques.

SUMMARY OF THE INVENTION

The present invention relates to an earth-retaining module and to a system and method employing a plurality of such earth-retaining modules, to stabilize earthen embankments and to stop sand erosion along beaches.

The present invention provides a means of stabilizing earthen embankments, sand dunes or sand shore embankments, through the employment of an earth-retaining module and earth-retaining system composed of a plurality of modules. The earth-retaining module and system provide for a precast (reinforced or nonreinforced), concrete, earth-retaining module, which is typically manufactured off-site and shipped to the site for installation, which system permits the stabilization of earthen embankments, or sand dunes or sand shore embankments, without undue disburbance of the existing, sensitive, environmental conditions.

The earth-retaining module of the invention comprises a module which is adapted for use with a plurality of other said modules in a side-by-side relationship and a row-by-row step-back relationship, with the modules interlocked in each row above the first row, and all rows secured together in a side-to-side relationship, to provide for a continuous face surface of each row, either straight or curved, as desired, to form an interlocked, earth-retaining wall system.

The earth-retaining module comprises an upright front and integral upright side walls, to form a generally U-shaped structure open at the top, bottom and back and adapted to receive earth or sand therein within the module structure. The module includes side walls, optionally and preferably, each having a rear, straight, sloped, side section extending from the top of the side wall rearwardly to a selected point on the rear of the side wall. In addition, each of the side walls has an open notch on the top surface thereof, the notches on each side being longitudinally aligned, and with the open notches of sufficient width, to accept, in an interlocking, retaining and securing manner, the width of the front wall of a module in a row above in the earth-retaining system.

The module, optionally and preferably, includes therein a dead-man mounting or support means, typically on the interior side wall beneath the sloping section of the side wall, and generally composing a short, inward portion of the side wall on each side, and one or more dead-man slab elements, typically a removable, precast-concrete, dead-man slab element, which is mounted on the dead-man slab-mounting or support means, and which extends between the support means across the rear of the open structure of the module. The module also includes means to secure the side walls of the said module to the side walls of adjoining modules in each row, and typically such means includes one or more, and particularly a plurality of, preformed holes which may be aligned with the holes in the side wall of an adjoining module, the modules secured together by using alignment pins or bolts, typically constructed of atmospheric, corrosive-resistant (ACR) material, to hold the modules together in a side-by-side, secured arrangement.

The module includes front and side walls generally integrally cast and of the same height, wherein the side walls include a sloped section, typically at an angle of about 45°, extending from the last 35% to 40% of the rear of the side walls downwardly to a defined height, typically 20% to 40% of the height of the side walls, and the side walls include at least one, generally rectangular, U-shaped notch therein, the notch(es) generally positioned intermediate the length of the side walls.

The earth-retaining wall system of the invention comprises a plurality of the earth-retaining modules secured together in a side-by-side relationship to form a row, and which includes a plurality of rows generally in a step-back arrangement. A plurality of the earth-retaining modules are arranged and secured together in an aligned row on a generally level-ground pad or area, to form a row, as desired, of the modules linked together with the retaining pins or bolts. A plurality of modules are then formed in second and subsequent rows, the modules secured together in a side-to-side arrangement, with each row set back a defined distance from the preceding row, to provide an earth-retaining wall system at the desired angle, with all of the modules filled with earth or sand. The rows may have the same or a different number of modules, but typically the upper rows have less modules than lower rows. The open aligned notches of the secured-together modules of one row provide for the insertion of the front wall of the modules of the next succeeding row to be fitted and interlocked therein, and typically with the modules in the next succeeding row being positioned such that the front row is generally intermediate two, lower, secured modules of the lower row. It is recognized, of course, that the open notches may be at different positions on the side wall; for example, with one or two notches in the top of the side wall, as desired, to provide for a desired slope of the earth-retaining wall system; for example, a 30° to 60° angle.

The earth-retaining wall system employing the modules is generally installed within a dune or shore-line embankment, to provide a secured, interlocked infrastructure, guarding against erosion and for stabilizing an earthen embankment. The modules, when filled and covered with earth or sand, will maintain the natural appearance of an earthen embankment or a sand-dune or sloped-beach embankment, to protect existing, sensitive, environmental conditions, and also preserve the general aesthetic appearance of a sand beach, sand dune or embankment.

Further, it has been found that the module-containing system will, during an ocean storm, protect the shore line or sand-dune embankment from being eroded excessively by storm-wave action. The portion of the system exposed by controlled erosion can be recovered easily with beach sand and stabilized with beach grass, salt-marsh plants and the like. The module-containing system not only provides protection against storm-wave erosion action, but also, due in part to the stepped-up, interlocked configuration of the wall system, provides a means by which the forces of any incoming waves are sheared horizontally and generally at 2-foot-thick shear planes, and, therefore, effectively dispersing and diminishing the overall horizontal force of the water on the wall system. For locations where it is not economically feasible to recover the module wall-system structure with beach sand, the system provides an alternative ground cover, by planting beach grass or plants in the 2-foot-wide sand terraces provided by the exposed core of the module, itself. It is also recognized that the exposed faces and surfaces of the modules can be upgraded by selected finishes, such as by painting or sculpturing designs, to provide a variety of aesthetic appearances to blend with the environment.

The precast, concrete, earth-retaining modules may be manufactured and cast easily to a size and weight well within the safe lifting capacity of a small, for example, rubber-tire backhoe or other vehicle used on beaches. For special slope requirements and soil conditions, the module can be modified in size and weight, to meet a variety of conditions and provide a variety of wall systems. As related, the precast modules may be set and secured side-by-side on natural ground or on permawet sand, without the necessity of a foundation, to form a solid foundation, after being sand- or earth-filled, on which subsequent rows of the modules may be installed to a desired height of the overall wall system. The entire module wall system works together in an interlocking manner, to provide a continuous, concrete-reinforcing and maintenance wall system, which provides for the integrity of an earthen embankment against aggressive weather conditions, as well as against naturally occurring phenomenon of soils to erode and sheet.

Earth-retaining modules and the resulting earth-retaining wall system made of such modules provide for unique features which overcome many of the disadvantages of prior-art techniques and methods of stabilizing earthen embankments and preventing sand erosion. Generally, the average weight of each module in a precast form would represent about 1800 pounds, where each module provides a unique, interlocking shape, due to the open notch indentations on the top surface of the side walls. The modules may be used in a variety of landscaping and unique terraces, plant developments and for other block-type uses. The dead-man slab element employed is typically a removable, flat, heavy, plank-like, dead-man slab element, whose weight, width and shape, as a precast anchor, may be adjustable, to accomodate specific soil conditions from wet to supersaturated sand. The module also has a center of gravity which will not overturn under severe hydric conditions, and provides for shear-force diffusion exerted against the module under severe storm conditions.

The earth-retaining module also maintains the cohesion of two, separate, specific, soil conditions with different specific gravities, or a condition which usually precipitates large-scale erosion or sheeting of soils; for example, mud slides, and, therefore, permits soil cohesion in the module. The module also permits drainage, having an open top and bottom surface, so that self-draining occurs. The modules are low-cost and easy to repair or maintain, and permit expansion of the wall system, by adding on to an existing module wall at either end, by placing modules on existing or having additional rows. In one particular advantage, the modules do not require, although they may use, a footing, since typically the earth-retaining modules form their own base, once filled with earth or sand. The earth-retaining modules avoid disturbance to the environment, since there are no concrete forms to construct on site, and the modules are easily interlocked together, to form the module wall-retaining system, since, after the initial first row has been set at a location, the remaining rows are simply installed by a very small work force.

The earth-retaining modules of the invention permit an easy method of installing an earth-retaining module-wall system. The method of preparation merely requires the preparation of a level pad of desired width; for example, of approximately 8 feet wide, and to the required length. Typically, the pad can be cut into a natural, existing, bearing soil or sand having a uniform-moisture content. The module is installed and filled, with the fill preferably consisting of clean sand and/or gravel compacted to 95% maximum density, to provide a stable pad base.

In use, the earth-retaining modules of the first or base row are set up, simply by aligning the modules in a side-by-side relationship, so that the front walls form a continuous, straight or curved surface, and alignment pins, constructed of ACR material, are inserted into the holes on the side walls, to hold the earth-retaining-module units together in a secured side-by-side relationship within the row. The first or bottom row is then back-filled with clean back fill or naturally occurring sand of approximately 12 inches, and then compacted. After the partial filling of the open structure of the earth-retaining module, the precast, concrete, dead-man, slab element is then placed on the support mounts, and the back fill continued and compacted generally up to the bottom side of the side-wall open notches. Any fill placed typically should extend from the inside face of the front wall to the naturally occurring earth within an embankment or sand dune.

A wall system is then constructed, by setting up the next row of the precast modules, by fitting generally a portion, typically the center, of the front wall of the module into the open, adjoining notches of the first row of modules, and bolting or pinning together the next row of modules, to form a side-by-side relationship. The second row is then filled and compacted, as before, with earth or sand, generally up to a level with the bottom of the open wall notches, and this procedure of forming rows is repeated for all required, successive rows, with each row set back, and typically with the number of earth-retaining modules in each row generally less than a succeeding row. Where a sand-dune stabilization is required, it is often desirable to cover the earth-retaining wall-system structure with earth or sand to the required slope; for example, 4:1 is recommended. For exposed or earth-retaining wall structures, landscaping of the horizontal modules and terraces can be carried out as specified or required.

The invention will be described for the purposes of illustration only, in connection with certain embodiments. However, it is recognized that various modifications, changes, additions and improvements to the illustrated embodiments may be made by those persons skilled in the art, all without departing from the spirit and scope of the invention.

DESCRIPTION OF THE EMBODIMENTS

Figure 1:
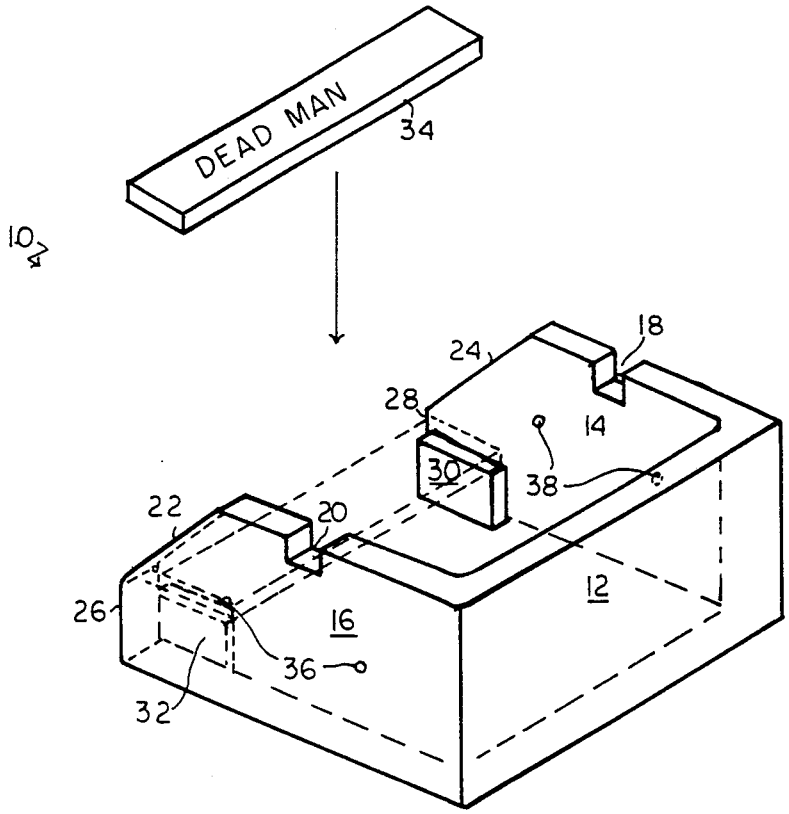
FIG. 1 is a partially exploded, perspective view from above of the earth-retaining module of the invention.

FIG. 1 is an illustrative, partially exploded, perspective view from above of an earth-retaining module 10 of the invention, showing a vertically upright, front wall 12 and side walls 14 and 16, each side wall having generally rectangular, open notches 18 and 20 generally placed intermediate the length of the side walls. The side walls include 45° straight, sloped sections 22 and 24 extending down to a section of the side walls 26 and 28 at the rear end thereof. The module 10 typically is comprised of a precast concrete, and includes, within the side walls 14 and 16, integrally cast, dead-man, slab-mounting or support elements 30 and 32 which extend slightly inwardly from the side walls beneath the slope sections 22 and 24. The module 10 includes, optionally, but preferably, a dead-man slab element 34 which is adapted to be placed on and be supported by the support and mounting elements 30 and 32 within the open structure of the module 10. The module 10 also includes bolt or pin sleeve holes 36 and 38 on the side walls 16 and 18, so that bolts or pins may be used, to place the side walls of adjoining modules 10 in an aligned, secured position.

While single, open, rectangular, U-shaped notches 16 and 18 are shown on the top wall of the side walls 14 and 16, it is, of course, recognized that the position of the notches may be changed, in order to control the angle of the earth-wall module system, or additional, open notches may be placed, if desired, along the top of the side walls 16 and 18. In addition, it is also recognized that, although a single, dead-man, precast, concrete slab element 34 is shown, one, two or more dead-man elements may be employed, if desired, to provide the proper weight to the rear section of the module 10; for example, with dead-man slab elements 34 stacked one on top of the other. The module 10, as illustrated, is shown with an open top and bottom structure and an open back structure, and is adapted to have the open structure filled with earth or sand, and then the dead-man slab elements, where employed, are placed on the mounting means 30 and 32, and then additional sand or earth placed therein, generally up to the lower portion of the notch elements 18 and 20.

A particularly useful, precast module 10 would have a front-wall and a side-wall length of about 5 feet, a height of about 2 feet and 4 inches for the front wall and side walls, and a 45° rear slope, and the slope having a height at the rear of the side walls 14 and 16; that is, the height 26 and 28, of about 10 inches, with the mounting support blocks 30 and 32 having a height of about 8 inches and a length of about 1 foot and 2 inches, and where the open notches 18 and 20 have a width of 5 inches and a height of 4 inches, and wherein the notches are placed about 2 feet from the front wall 12 of the module 10. The slab element 34 may have a thickness of 2 inches and a width of 14 inches.

Figure 2:
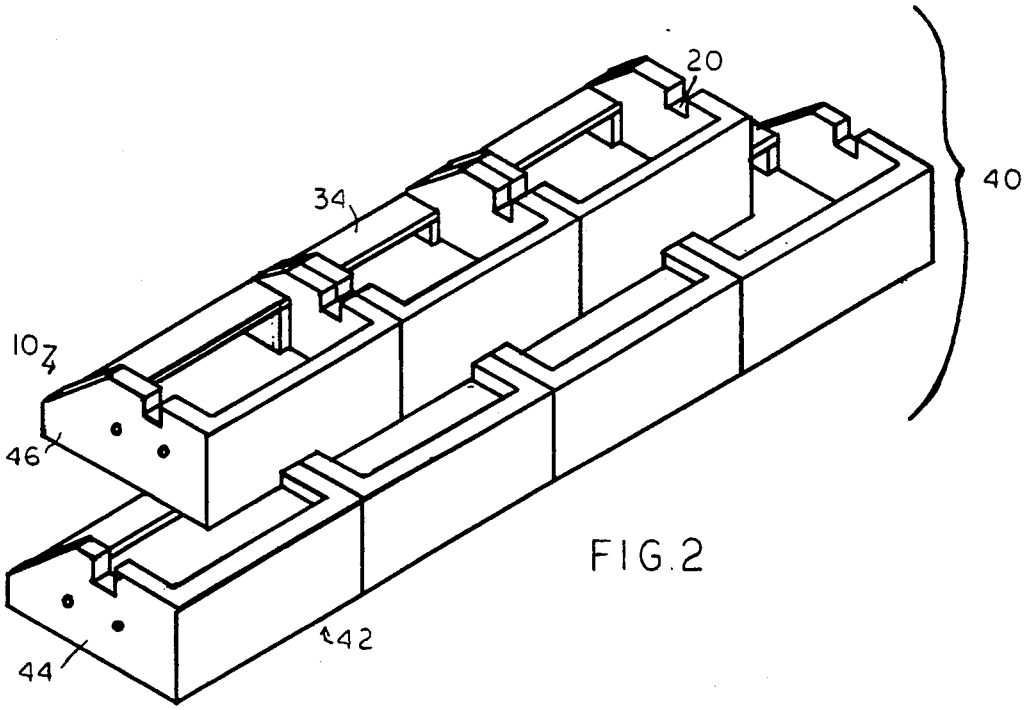
FIG. 2 is a schematic, perspective view from above of an interlocked wall system of the invention, employing the module of FIG. 1.

FIG. 2 is an illustrative, perspective view from above of a plurality of the earth-retaining modules 10 of FIG. 1, shown without earth or sand therein, in a module wall-retaining system 40, wherein the first rows 44 of modules 10 are shown interlocked together, by securing bolts or pins through the aligned, adjoining bolt holes 36 and 38 of the modules, to form a first row of modules 44 in a straight-line fashion, with a continuous front surface on a prepared base 42. The second rows of modules 46 are secured together in a like manner, and, as illustrated and shown, the modules 10 are at each of the front walls 12 and placed within the adjoining notches 16 and 18 of each module 10 of the base row 44, to secure the modules 10 in position. The modules are slidably positioned, so that the modules 10, in the second row 46, are generally equally positioned on either side of the modules on the lower row 44. FIG. 2 is an illustration showing the dead-man anchor slabs 34 in position, and without earth or sand within the modules, for the purposes of illustration and explanation only.

Figure 3:
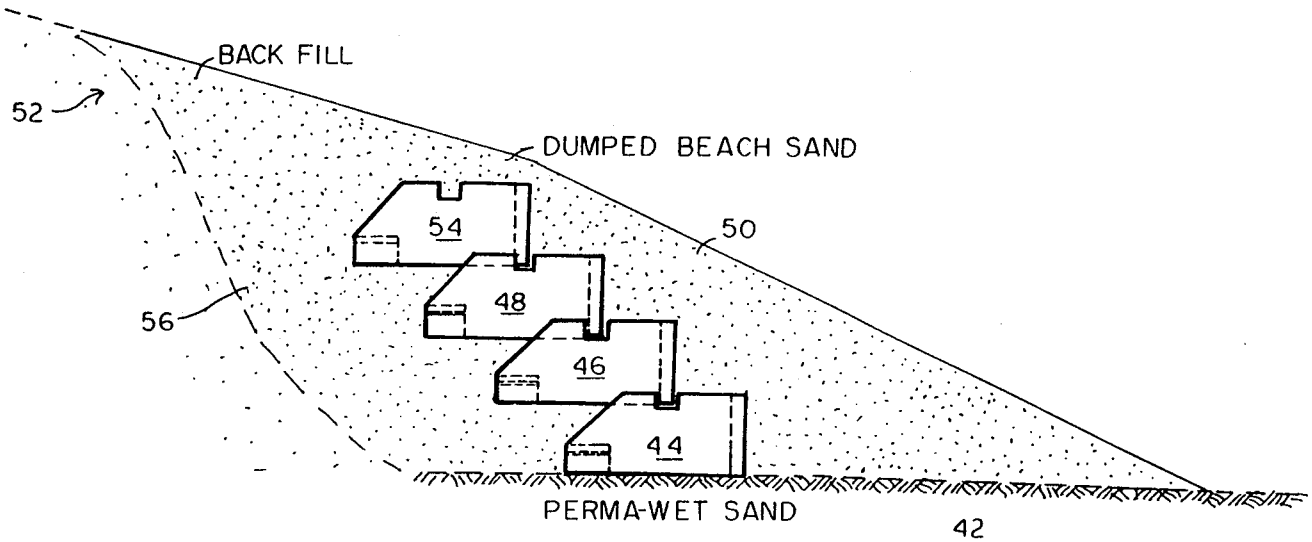
FIG. 3 is a schematic, illustrative, sectional view of the earth-retaining wall system of the invention, employing the module of FIG. 1.

FIG. 3 is an illustrative, sectional side view of an earth-retaining, module wall system of the invention, employing an earth-retaining, module wall system, to protect the erosion of sand from a beach area, wherein there is a plurality of rows 44, 46, 48 and 54 of modules 10 interlocked together, by securing the side walls of the modules and also by placing the front walls of the modules 10 in the open notches of the lower row of modules. As illustrated, the modules are based on a permawet sand base 42 and include a dumped, beach-sand covering 50 and include existing sand dune 52 and a layer 56 of back-filled, compacted, 90% MD. The modules 10 in each of the rows 44, 46, 48 and 54 have been filled with beach sand and contain dead-man slab elements 34 therein.

Figure 4:
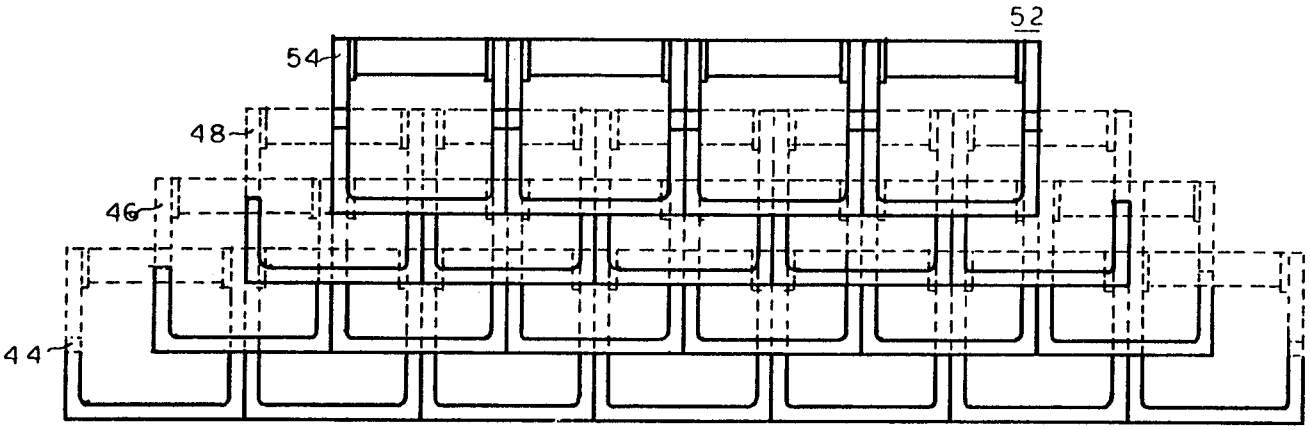
FIG. 4 is a top plan view of the wall system of FIG. 3.

FIG. 4 is a top plan view of the earth-retaining, module wall system, as illustrated in FIG. 3, and also shows the side-by-side relationship of the modules 10 in each of the rows 44, 46, 48 and 54, and the interlocking of the front walls of each module, in rows 46, 48 and 54, to the notches in the side walls of the row of lower modules. The earth-retaining, module wall system, as illustrated in FIG. 4, shows a typical plan view, as in FIG. 3, for a sand-dune stabilization, to prevent the erosion of sand from the existing sand dune.

Earth-retaining modules and wall systems produced by the modules and the method of constructing the wall systems provide significant and important advantages, for stabilizing earthen embankments and protecting the erosion of sand over the existing methods presently employed for these purposes.

What is claimed is:

1. An earth-retaining, concrete module adapted for use with other modules, to form an interlocked, earth-retaining wall system, to stabilize earthen embankments and to stop erosion along ocean beaches, which module comprises:

a) an upright front wall and upright side walls connected therewith, to form a generally U-shaped structure open at the top and bottom and adapted to receive fill therein;

b) each of the side walls having open notches, which notches are longitudinally aligned in the top of the side walls, the notches of sufficient width to accept, in an interlocked manner, the width of the front wall of a module in a higher row in the system;

c) dead-man, slab-element-mounting means on the interior, rear side walls;

d) a dead-man slab element extending across the structure and mounted on the slab-element mounting means; and e) means to secure the side walls of the said module to the side walls of the adjoining module in a system.

2. The module of claim 1 wherein each of the side walls has a rear, straight, sloped, side section extending from the top of the side wall to the end of the side wall.

3. The module of claim 2 wherein the angle of the sloped section of the side walls has a slope of about 45°, and extends to the rear of the side walls at a height of up to about one-half the height of the side walls.

4. The module of claim 1 wherein the module and the dead-man slab element comprises precast concrete.

5. The module of claim 1 wherein the upright front wall and the upright side walls are of the same height.

6. The module of claim 1 wherein the open notches are generally U-shaped and generally intermediate the length of the side walls.

7. The module of claim 1 wherein the slab-element-mounting means comprises short, raised, inwardly projecting shelves extending inwardly from the side.

8. The module of claim 1 wherein the means to secure the side walls of said module to the side walls of an adjoining module comprises a plurality of spaced-apart holes, for the insertion of retaining pins or bolts therein.

9. The module of claim 1 wherein the length of the front wall and of the side walls is approximately equal.

10. The module of claim 2 wherein the front wall has a length of about 5 feet and a height of about 2 feet and 4 inches, and wherein the side wall has a length of about 5 feet, and the rear sloped section extends to a height of about 10 inches at the end of the side wall, and wherein the open notches have a width of about 5 inches and a depth of about 4 inches.

11. The module of claim 1 which includes the interior, open section of the module filled with earth or sand.

12. A wall system for retaining an earthen embankment or sand from erosion from a dune, which system comprises a) a plurality of the earth-retaining modules of claim 1;

b) a plurality of said modules arranged in a first row and in a secured-together position by aligned side walls, and the modules on a generally level-ground area, the modules filled with earth or sand; and c) a plurality of said modules arranged in an aligned, secured-together, abutting second or subsequent plurality of rows, each row of said modules set back at a set-back position from the preceding row of said modules, and all of said modules filled with earth or sand, the rows set back a distance, to form an earth-retaining wall system of selected angle, to retain an earthen embankment or stop erosion from sand, the second row set on the first row and succeeding rows set on prior rows, the front walls of each modules in each subsequent row interlocked into the aligned, side-wall notches of the lower modules in the lower row in the system, to form a wall system.

13. The system of claim 12 wherein the said modules are secured together by alignment pins or bolts to the means to secure the side walls of said modules to the side walls of adjoining modules, the modules in each row forming a generally continuous, front-wall surface.

14. The system of claim 12 which includes covering the wall system, composed of a plurality of said modules, with earth or sand to a desired slope.

15. The system of claim 12 wherein the wall system comprises from 2 to 6 rows of said modules.

16. The system of claim 12 wherein each row of said modules in the system, starting from the base row upwardly, contains less modules in said row than the preceding lower row.

17. A method of preparing an earthen embankment and to stop sand erosion, which method comprises:

a) providing a plurality of earth-retaining, concrete modules which includes an upright front wall and upright side walls connected therewith, to form a generally U-shaped structure open at the top and bottom and adapted to receive fill therein;

each of the side walls having open notches, which notches are longitudinally aligned in the top of the side walls, the notches of sufficient width to accept, in an interlocked manner, the width of the front wall of a module in a higher row in the system;

dead-man, slab-element-mounting means on the interior, rear side walls;

a dead-man slab element extending across the structure and mounted on the slab-element mounting means; and means to secure the side walls of the side module to the side walls of the adjoining module in a system;

b) preparing a level-ground pad of required length and width, and aligning a first row of said modules side-to-side, to form a continuous, straight surface of the front-wall panels of said modules, and securing the modules, in an aligned, side-by-side position;

c) back-filling the first row of said modules with earth or sand and placing a dead-man slab element in position within the modules;

d) continuing the fill of earth or sand and compacting the same up to about the bottom side of the open notches of the side walls;

e) aligning a second row, and further rows as required, of said modules, by fitting the center of the front walls of the modules into the open notches of the modules of the first or lower rows; and f) filling the said modules of the second and other rows with earth or sand up to about the level of the bottom of the side-wall notches, and repeating the procedure for required successive rows of said modules, to form tan earth-retaining wall system.

18. The method of claim 17 which includes covering the wall system with sand or earth.

19. The method of claim 17 which includes reducing the number of said modules in each row, starting from the base row upwardly.

* * * * *